US005184360A

United States Patent [19]

Gonzalez

[11] Patent Number: 5,184,360

[45] Date of Patent: Feb. 9, 1993

[54] CHILD'S PLAYHOUSE WITH BED ON TOP

[76] Inventor: Marta Gonzalez, 4430 NW. 207th Dr., Miami, Fla. 33055

[21] Appl. No.: 797,173

[22] Filed: Nov. 25, 1991

[51] Int. Cl.[5] ..... A47D 7/00; A47C 19/22

[52] U.S. Cl. ..... 5/2.1; 5/9.1; D6/388

[58] Field of Search ..... 5/2.1, 8.1, 9.1, 400, 5/93.1; D6/388, 389

[56] References Cited

U.S. PATENT DOCUMENTS

| | | | |
|---|---|---|---|
| D. 167,632 | 9/1952 | Jackson | D 6/388 |
| D. 189,741 | 2/1961 | Gatov | 5/2.1 |
| D. 218,512 | 8/1970 | Wyatt et al. | D 6/388 |
| D. 249,403 | 9/1978 | Lamb | 5/93.1 |
| D. 294,893 | 3/1988 | Mowery et al. | D 6/388 |
| 3,188,661 | 6/1965 | Rudy | 5/97 |
| 3,638,246 | 2/1972 | Jewell | 5/2.1 |
| 4,312,086 | 1/1982 | Bianco | 5/9.1 |

*Primary Examiner*—Alexander Grosz
*Attorney, Agent, or Firm*—Malloy, Downey & Malloy

[57] ABSTRACT

A platform bed assembly, to be used by a child as a sleeping area and a play area, the bed assembly includes a lower base structure structured and disposed to resemble a large scale version of a toy article such as a van or house. The platform bed assembly includes a mattress support platform positioned and secured atop the base structure whereon a mattress may be placed in overlying position, thereby defining a sunken sleeping area, includes a ladder secured to the base structure so as to allow faciliated access to the sleeping area, and includes a door in a side wall of the base structure to allow access to an interior compartment defining the play area. Additionally, there are a plurality of toy accessory components positioned within the interior compartment which correspond the design of the toy article, and add realism to the play environment.

8 Claims, 5 Drawing Sheets

CHILD'S PLAYHOUSE WITH BED ON TOP

BACKGROUND OF THE INVENTION

1. Field of the Invention

This invention relates to a platform bed assembly including a lower base portion, resembling a large scale version of a toy article, and a sunken sleep area positioned therein, thereby providing a child with a safe sleep area as well as a realistic play area.

2. Description of the Prior Art

Increasingly, elevated beds are becoming common place in the bedrooms of children, partially for a need to maximize space in the child's bedroom. For this reason, a platform bed assembly that combines a sleep area with a play area would be highly desirable. In the past, other attempts have been made to combine a sleep area with other useful items, such as a closet as shown in the disclosure to Jewell, U.S. Pat. No. 3,638,246. The assembly of Jewell, while maximizing space, is not adapted to be used by a child as it merely includes a mattress positioned atop the collapsible closet, and does not provide a safe sleeping area for a child who may tend to roll to the sides of the bed, nor does it provide a play area to function as a child's creative outlet. A second example of an attempt to combine a sleep area with a player area may be seen in U.S. Design Pat. No. 218,512 wherein a bunk bed unit resembling a wagon is disclosed. As this is a design patent, it merely discloses the exterior portions of the bunk bed unit, and as viewed from the drawings, it does not include a safe sunken sleep area for a child or a plurality of toy accessory components within. As a result, there is still a need for a platform bed assembly which provides a safe sleeping area, is made of a durable, sturdy, safe material, and is adapted to provide an interactive and entertaining creative outlet for a child.

Applicant's invention as claimed is designed specifically to overcome the shortcomings of prior assemblies. Applicant's platform bed assembly provides a safe environment during both sleep and play, and is an interactive and attractive addition to any child's room.

SUMMARY OF THE INVENTION

The present invention is directed towards a platform bed assembly to be used by a child as a sleep area and a play area. The assembly includes a lower base structure which is structured and disposed to resemble a large scale version of a toy article such as a van or a playhouse. Located within an interior compartment formed by the base structure are a plurality of toy accessory components positioned and structured to correspond the toy article after which the base structure is modeled. Further included in the base structure are a plurality of window openings, a door to allow entrance to the interior compartment, and platform support means integrally formed as part of the base structure. Secured atop the platform support means is the mattress support platform. The mattress support platform which is adapted to receive the mattress in overlying relation thereon, is structured so as to form a sunken sleep area, thereby providing a safe sleeping environment for a child. Additionally, there is a ladder secured to the base structure and positioned so as to allow facilitated access to the sunken sleeping area. Finally, the base structure is formed of a relatively lightweight, rigid, sturdy plastic or like material, whose components are securely interlocked, but are also capable of quick and easy movement and disassembly by an adult.

It is a purpose of this invention to provide a safe and appealing play environment which will maximize a child's creative energy.

It is also a purpose of this invention to provide a safe, secure sleeping area that will maximize the space in a child's room and provide a child with a unique environment.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Shown throughout FIGS. 1–9 are four embodiments, 10, 11, 12 and 13, of the applicant's platform bed assembly, which combine a safe sunken sleep area 50 with a lower base structure 20 which functions as a creative and interactive play area.

Figure 1:
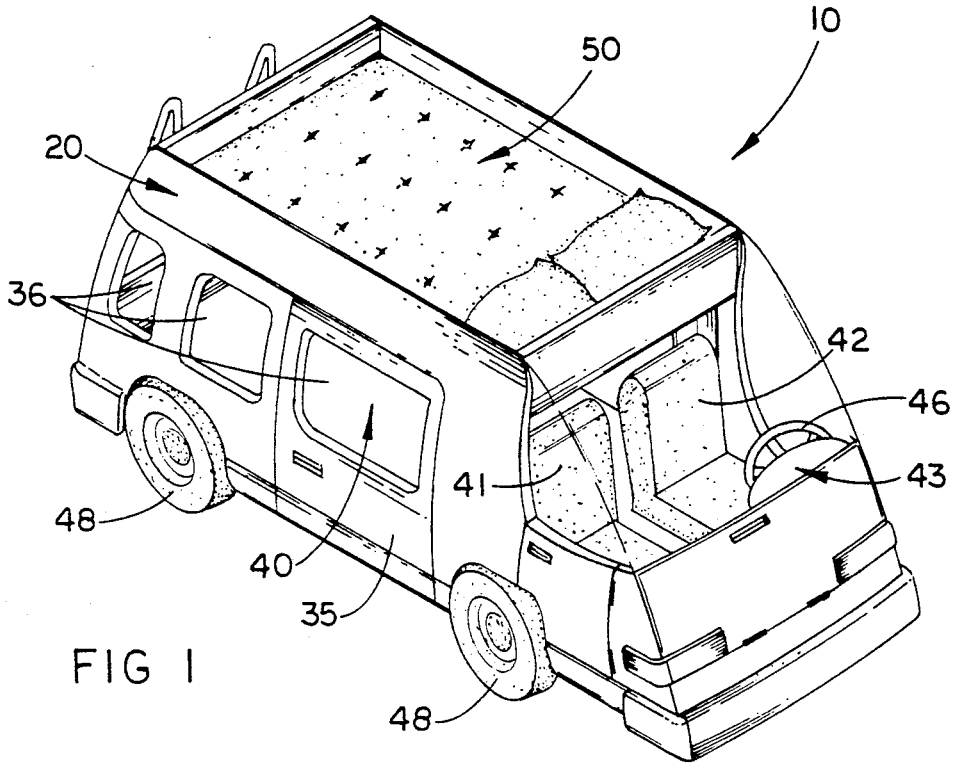
FIG. 1 is a perspective view of the first embodiment of the platform bed assembly.
Figure 2:
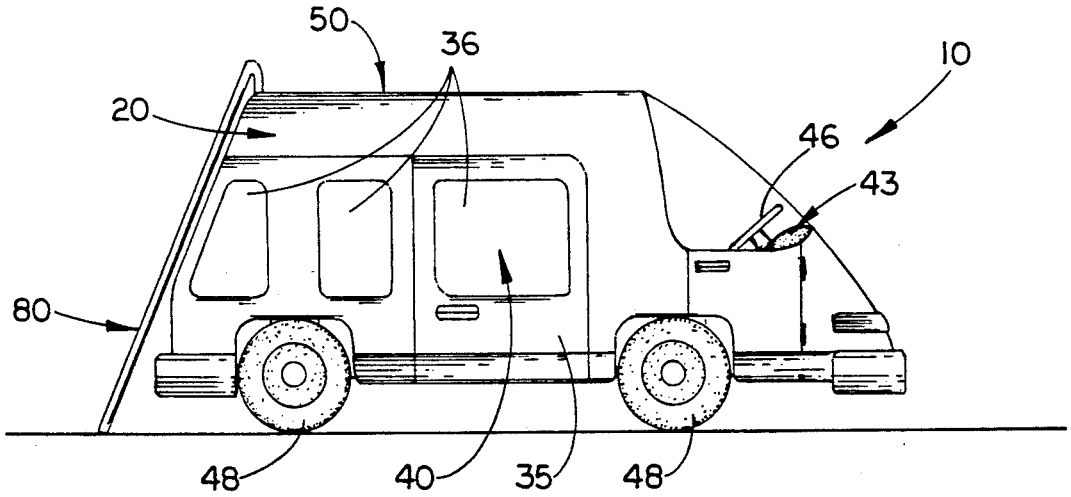
FIG. 2 is a side view of the first embodiment of the platform bed assembly.
Figure 3:
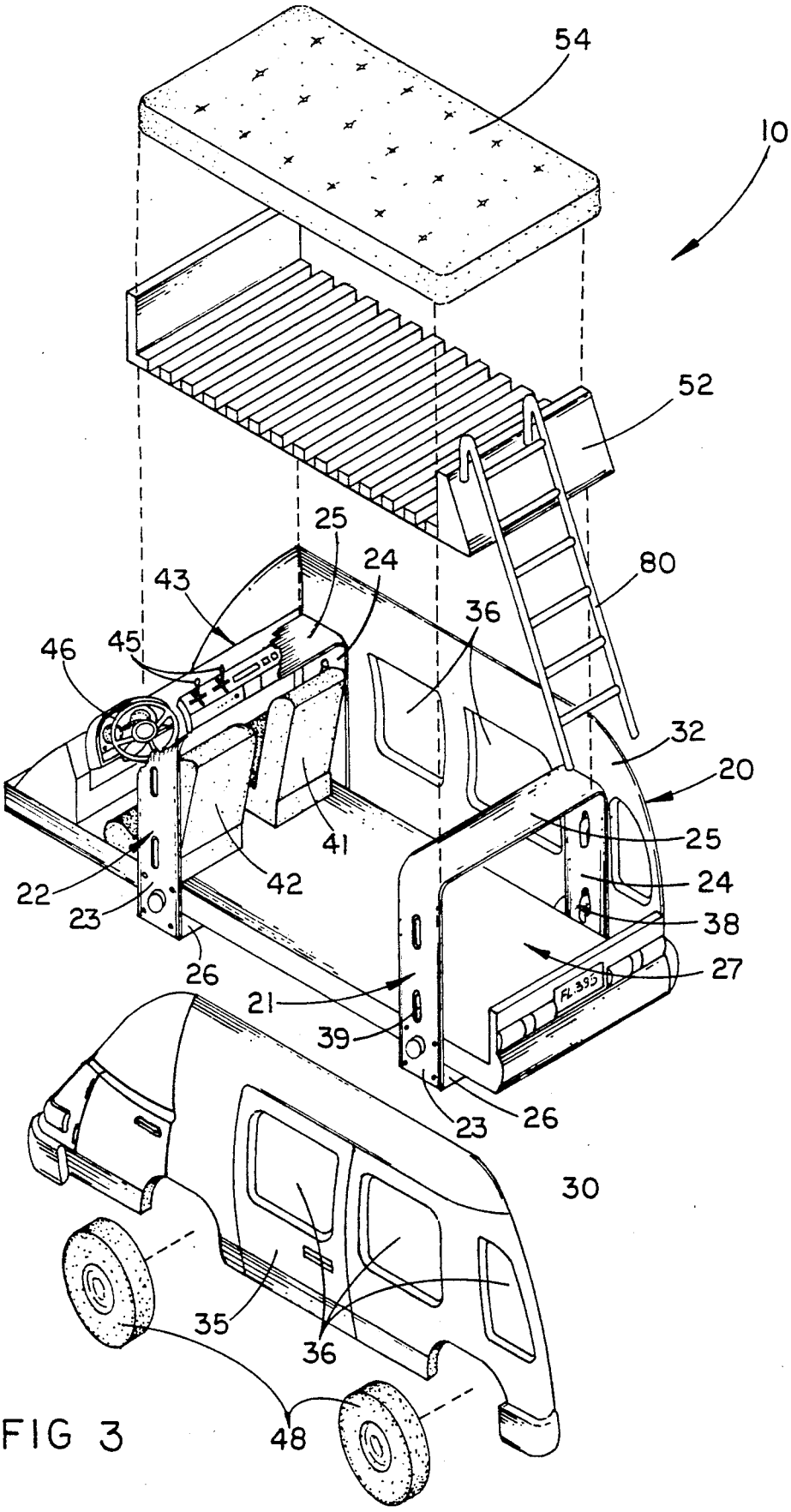
FIG. 3 is an exploded view of the first embodiment of the platform bed assembly.

Turning to FIG. 1, the first embodiment of the platform bed assembly 10 includes a lower base structure 20 resembling a van and including an inner compartment 40 which defines the play area. Referring to FIG. 3, the lower base structure 20 includes a pair of generally square support brackets 21 and 22 positioned in spaced apart relation from one another. Each of the support brackets 21 and 22 includes a pair of vertical sides 23 and 24, an upper side 25, and a lower side 26. The lower base structure 20 which rests on the lower side 26 of the support brackets 21 and 22 further includes a generally elongate floor portion 27. The floor portion 27, which is positioned within an open central portion 25' of the support brackets 21 and 22 is secured to the vertical sides 23 and 24 of the support brackets 21 and 22 in a position that is slightly elevated from the lower side 26 of the support brackets 21 and 22. Further defining the interior compartment 40 of the lower base structure 20 are a pair of oppositely disposed elongate side walls 30 and 32. The side walls 30 and 32, which include a plurality of protruding hook portions 38 extending from an interior there. , are secured to corresponding vertical sides 23 or 24 of the support brackets 21 and 22 by positioning the hook portions 38 into corresponding slots 39 formed in the vertical sides 23 and 24. The base structure 20 is thereby disassemable, but is also sturdy such that a child may not disconnect the assembly. Located within the interior compartment 40 of the lower base structure 20 are a plurality of toy accessories corresponding to a van. These toy accessories include passenger seat 41 and driver's seat 42 secured at a front portion of the floor portion 27 behind a dashboard 43. Positioned within the dashboard portion 43 is a steering wheel 46 and a pair of joystick-type video game controllers 45 which are structured and disposed to enable a child sitting in one of the seats 41 or 42 to play a video game connected to the joystick 45. Resting on the upper side 25 of the support brackets 21 and 22 is a mattress support platform 52 which defines the sleeping area 50. The mattress support platform 52, which is sunken to provide a safe sleeping area 50, is adapted to receive in overlying relation thereto a mattress 54, and is easily accessible by a ladder 80 secured to the mattress support platform 52. Referring back to FIGS. 1 and 2, the lower base structure 20 includes a plurality of windows 36 disposed throughout the side walls 30 and 32. Further included in one of the side walls 30 is a door 35 to allow access to the interior compartment 40. Finally, to add realism to the van design of the base structure 20, a plurality of tires 48 are secured to the support bracket 21 and 22 so as to give the appearance that the base structure 20 is resting solely on the tires 48.

Figure 4:
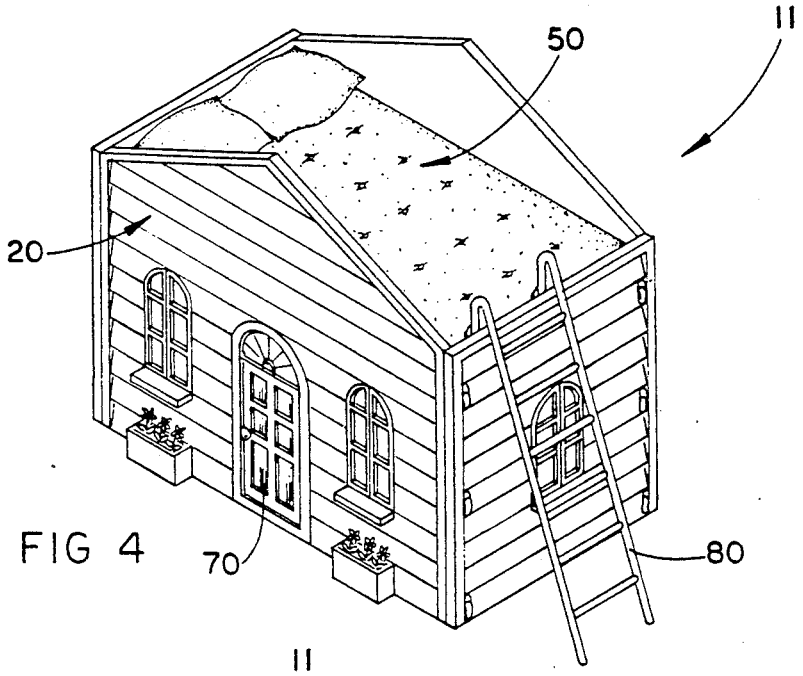
FIG. 4 is a perspective view of a second embodiment of the platform bed assembly.
Figure 5:
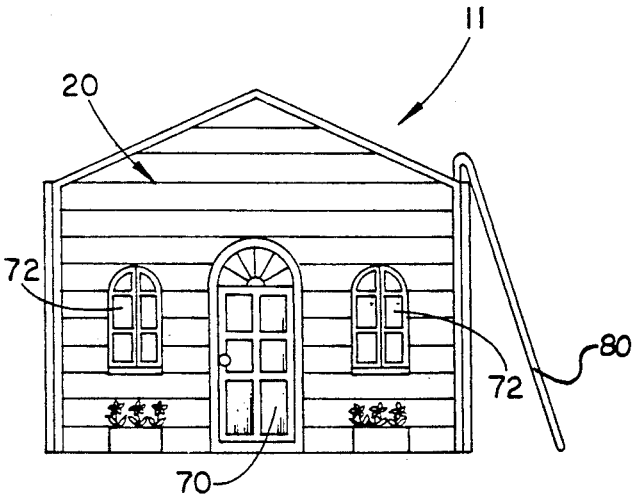
FIG. 5 is a front view of the second embodiment of the platform bed assembly.
Figure 6:
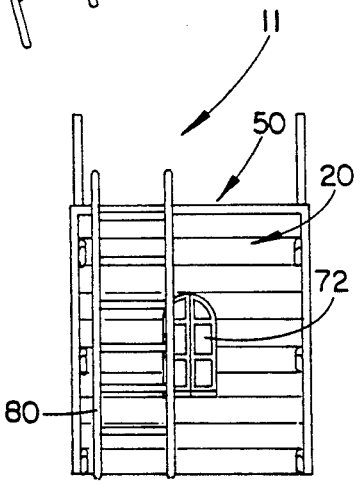
FIG. 6 is a side view of the second embodiment of the platform bed assembly.
Figure 7:
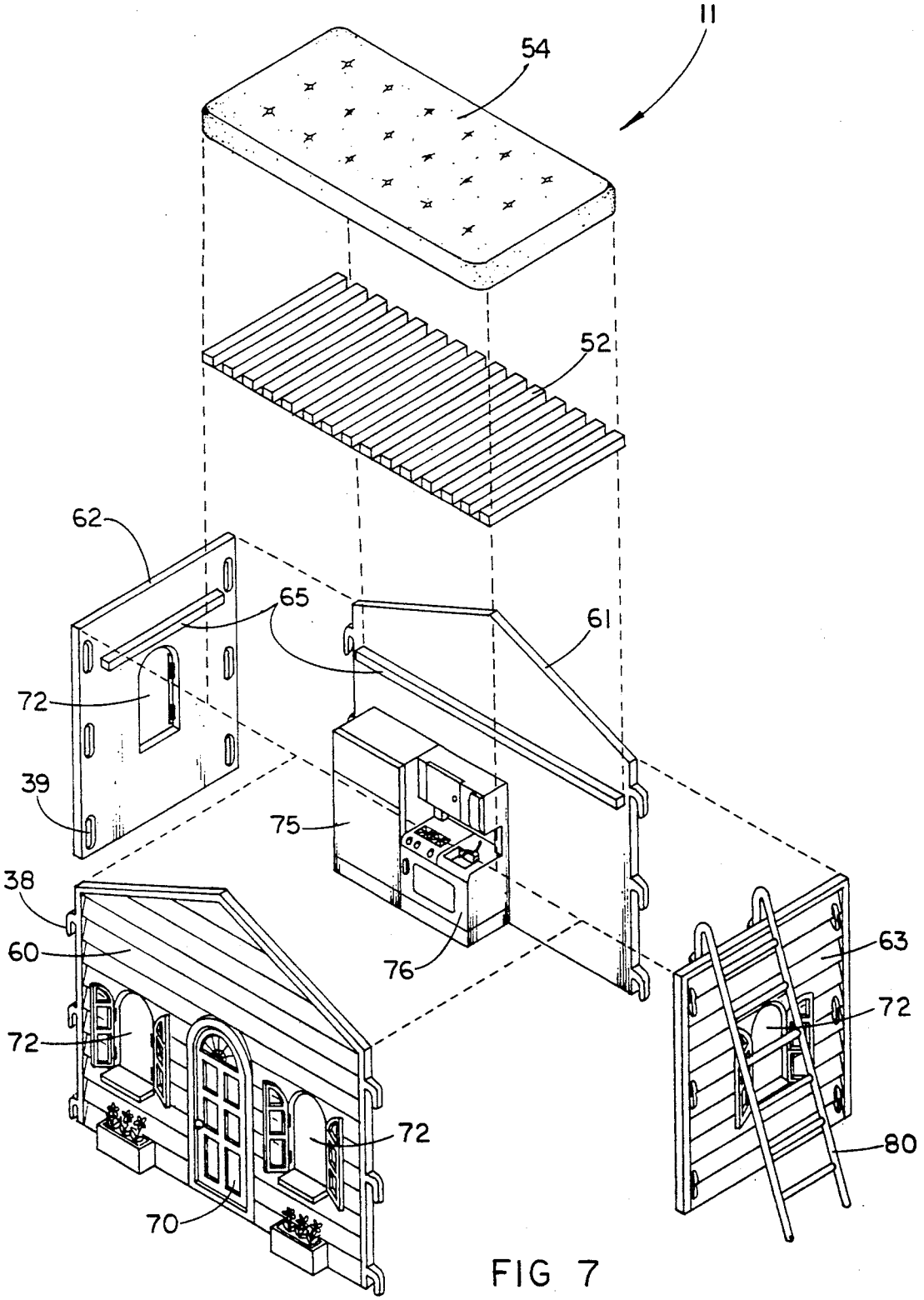
FIG. 7 is an exploded view of the platform bed assembly.

Turning to FIG. 4 and the second embodiment of the platform bed assembly 11, the lower base structure 20 resembles a house. As shown in FIG. 7, the lower base structure 20 includes primarily a front wall 60, a back wall 61, and a pair of side walls 62 and 63. The front wall 60 and the back wall 61 include a plurality of the hooked protrusions 38 extending from the opposite vertical edges thereof. The hook protrusions 38 are structured and disposed to be correspondingly fitted into the plurality of slots 39 in side walls 62 and 63, thereby forming a sturdy interlocking base structure 20, which may be disassembled by an adult if needed, but is safe for a child. Positioned along an upper portion of the walls 60, 61, 62 and 63, are a plurality of support ridges 65. The support ridges 65 are structured and disposed so as to supportably receive thereon the mattress support platform 52 upon which the mattress 54 is placed, thereby defining a sunken sleep area 50. Located within the base structure 20 are a plurality of toy accessory components, such as a toy refrigerator 75 and a toy oven 76 which provide a more realistic and interactive play area. Referring back to FIGS. 5 and 6, the base structure 20 includes a decorative front door 70 in the front wall 60 to allow access to the interior compartment 40. Disposed throughout the front wall 60 and the side walls 62 and 63 are a plurality of shuddered windows 72 which may be opened and closed by the child. Finally, the ladder 80 is included to allow facilitated access to the sleeping area 50.

Figure 8:
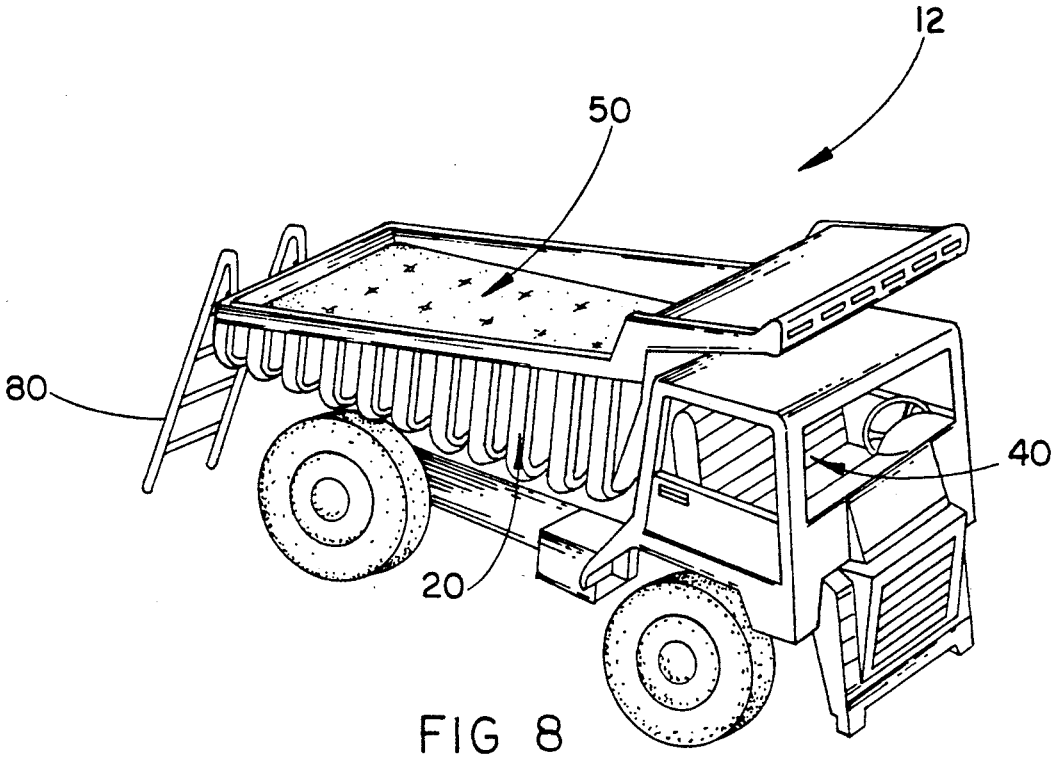
FIG. 8 is a perspective view of a third embodiment of a platform bed assembly.
Figure 9:
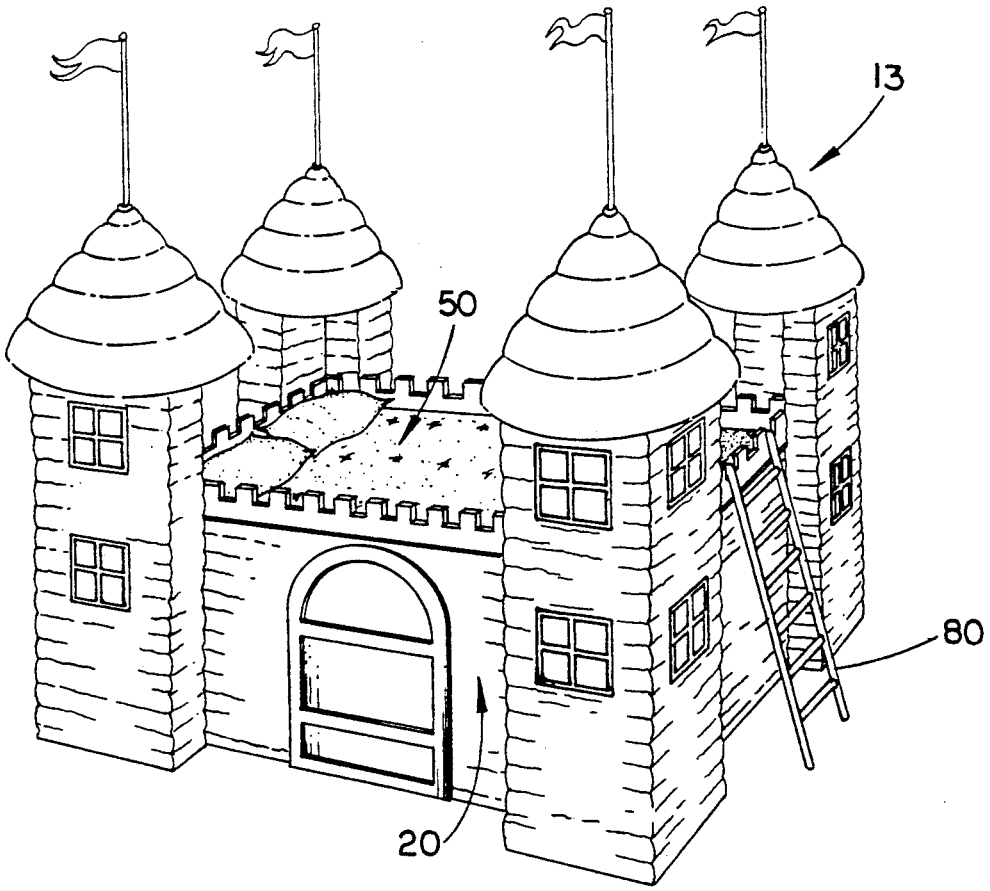
FIG. 9 is a perspective view of a fourth embodiment of the platform bed assembly.

As seen by the embodiments in FIGS. 8 and 9, the lower base structure 20 may be provided in a variety of forms, such as a dump truck shown as the third embodiment 12 of FIG. 8, or a castle shown as the fourth embodiment 13 of FIG. 9. Accordingly, it should be noted that other designs consistent with the doctrine of equivalents and the intent of the applicant may also be included.

Now that the invention has been described,

What is claimed is:

1. For use by a child, a platform bed assembly comprising:

a lower base structure, said lower base structure being structured and disposed to function as a play area and resemble a large scale version of a toy article.

said base structure including an interior compartment therein, a mattress support platform, said mattress support platform being supportably positioned and secured to said base structure by platform support means, a mattress positioned in overlying position on said mattress support platform, said platform support means including a pair of large, generally square support brackets positioned in spaced apart relation as part of said base structure, said base structure further including an elongate, generally rectangular floor portion passing through an open central portion of said support brackets and being secured at opposite longitudinal edges thereof to a lower portion of said pair of support brackets in a generally elevated position from a lower side of said support brackets, a pair of oppositely disposed elongate side walls secured to respective vertical sides of said pair of support brackets, a ladder secured to said base structure and positioned so as to allow facilitated access to said mattress and a sunken sleeping area defined by said mattress, a plurality of toy accessory components positioned within said interior compartment and corresponding to said toy article, and said base structure being formed of a relatively lightweight, rigid, sturdy plastic or like material.

2. A platform bed assembly as recited in claim 1 wherein said toy article resembles a van or similar vehicle.

3. A platform bed assembly as recited in claim 2 wherein said plurality of toy accessory components include a steering wheel, a dashboard portion, and at least one seat, all correspondingly structured and disposed to resemble the interior of a real van or similar vehicle.

4. A platform bed assembly as recited in claim 3 wherein said dashboard portion includes at least one joystick-type video game controller mounted therein such that the child may sit in said seat and play a video game connected to said at least one joystick controller.

5. A platform bed assembly as recited in claim 4 wherein one of said side walls includes a door for access into said interior compartment.

6. A platform bed assembly as recited in claim 5 wherein said base structure includes a plurality of tire-shaped articles correspondingly secured to said base structure.

7. A platform bed assembly comprising:

a lower base structure resembling a van or similar vehicle, said base structure including an interior compartment therein, a pair of large, generally square support brackets disposed in spaced apart relation as part of said base structure, each of said support brackets including a lower side, an upper side, and oppositely disposed vertical sides, a rectangular, generally elongate floor portion secured at opposite longitudinal ends thereof to a correspondingly positioned lower portion of each of said vertical sides, such that said floor portion is elevated above said lower side, a pair of oppositely disposed elongate side walls correspondingly secured to said support brackets at said vertical sides, a mattress support platform positioned atop said base structure so as to be supportably situated on said upper sides of said support brackets, a mattress positioned in an overlying manner on said mattress support platform, accessory components corresponding said van or similar vehicle positioned in said interior portion so as to resemble an interior of a real van or similar vehicle, said accessory components including a dashboard portion, a steering wheel, at least one seat, and at least one joystick-type video game controller, said video game controller being mounted in said dashboard portion such that a child may sit in said seat and play a video game connected to said controller.

a ladder secured to said base structure and positioned so as to allow facilitated access to said mattress and a sunkwn sleeping area defined thereby, and one of said side walls including a door to allow access to said interior portion.

8. A platform bed assembly as recited in claim 7 wherein a plurality of tire-shaped articles are correspondingly secured to said base structure.

* * * * *